US010490925B2

(12) United States Patent
Huang

(10) Patent No.: US 10,490,925 B2
(45) Date of Patent: Nov. 26, 2019

(54) ELECTRICAL CONNECTOR

(71) Applicant: LOTES CO., LTD, Keelung (TW)

(72) Inventor: Chang Wei Huang, Keelung (TW)

(73) Assignee: LOTES CO., LTD., Keelung (TW)

( * ) Notice: Subject to any disclaimer, the term of this patent is extended or adjusted under 35 U.S.C. 154(b) by 0 days.

(21) Appl. No.: 16/296,428

(22) Filed: Mar. 8, 2019

(65) Prior Publication Data

US 2019/0280414 A1 Sep. 12, 2019

(30) Foreign Application Priority Data

Mar. 9, 2018 (CN) ..... 2018 1 0192185
Apr. 23, 2018 (CN) ..... 2018 1 0368455

(51) Int. Cl.

| | |
|---|---|
| ***H01R 12/00*** | (2006.01) |
| ***H01R 13/24*** | (2006.01) |
| ***H01R 12/55*** | (2011.01) |
| ***H01R 12/52*** | (2011.01) |
| ***H01R 13/40*** | (2006.01) |
| ***H01R 13/514*** | (2006.01) |
| ***H01R 12/70*** | (2011.01) |
| ***H01R 13/6473*** | (2011.01) |

(Continued)

(52) U.S. Cl.

CPC ..... *H01R 13/2464* (2013.01); *H01R 4/02* (2013.01); *H01R 12/52* (2013.01); *H01R 12/55* (2013.01); *H01R 12/7076* (2013.01); *H01R 13/2407* (2013.01); *H01R 13/40* (2013.01); *H01R 13/502* (2013.01); *H01R 13/514* (2013.01); *H01R 13/6473* (2013.01)

(58) Field of Classification Search

CPC ..... H01R 12/52; H01R 12/55; H01R 12/58; H01R 13/40; H01R 13/2407; H01R 13/2464; H01R 13/6473; H01R 4/02
USPC ..... 439/65, 66
See application file for complete search history.

(56) References Cited

U.S. PATENT DOCUMENTS 7,390,195 B2 * 6/2008 Liao ..... H01R 13/2435 439/66
7,435,100 B2 * 10/2008 Chang ..... H01R 13/2435 439/66

(Continued)

FOREIGN PATENT DOCUMENTS

CN 207282768 U 4/2018

*Primary Examiner* — Khiem M Nguyen
(74) *Attorney, Agent, or Firm* — Locke Lord LLP; Tim Tingkang Xia, Esq.

(57) ABSTRACT

An electrical connector is used to be electrically connected to a chip module, and includes a body provided with at least one accommodating groove. The body has a supporting block protrudingly provided upward at one side of the accommodating groove, and the supporting block is configured to upward support the chip module. At least one terminal is correspondingly accommodated in the at least one accommodating groove. The terminal includes: a first base accommodated in the accommodating groove; an elastic arm formed by bending and extending forward from the first base and located at one side of the supporting block to be electrically connected to the chip module; and a through slot running vertically through the elastic arm. The supporting block has a rear end. The first base is located behind the rear end. The through slot extends forward and does not pass beyond the rear end.

20 Claims, 15 Drawing Sheets

(51) Int. Cl.
*H01R 4/02* (2006.01)
*H01R 13/502* (2006.01)

(56) References Cited

U.S. PATENT DOCUMENTS 8,323,038 B2 * 12/2012 Jin ..... H01R 12/714
439/66
8,535,093 B1 * 9/2013 Mason ..... H01R 13/6585
439/607.05
10,389,050 B2 * 8/2019 Huang ..... H01R 12/585

* cited by examiner

ELECTRICAL CONNECTOR

CROSS-REFERENCE TO RELATED PATENT APPLICATION

This non-provisional application claims priority to and the benefit of, pursuant to 35 U.S.C. § 119(a), patent application Serial No. CN201810192185.9 filed in China on Mar. 9, 2018 and patent application Serial No. CN201810368455.7 filed in China on Apr. 23, 2018. The disclosures of the above applications incorporated herein in their entireties by reference.

Some references, which may include patents, patent applications and various publications, are cited and discussed in the description of this disclosure. The citation and/or discussion of such references is provided merely to clarify the description of the present disclosure and is not an admission that any such reference is "prior art" to the disclosure described herein. All references cited and discussed in this specification are incorporated herein by reference in their entireties and to the same extent as if each reference were individually incorporated by reference.

FIELD

The present invention relates to an electrical connector, and more particularly to an electrical connector with adjustable terminal impedance.

BACKGROUND

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

A conventional electrical connector is electrically connected with a chip module and a circuit board. The electrical connector has an insulating body and multiple terminals mounted on the insulating body. Each of the terminals has a tail portion connected with the circuit board, and a spring arm portion which is connected with the chip module and is capable of elastically deforming. A tail end of the spring arm portion is provided with a contact portion to be connected with the chip module. The spring arm portion is provided with a slot, and the slot extends to the contact portion from a base of the elastic arm portion, such that two different contact points are formed between the contact portion and the chip module. With this arrangement, the elasticity of the elastic arm portion may be increased, and two conductive paths exist in the elastic arm portion. However, the slot extends to the contact portion from the base of the elastic arm portion, such that the inductive impedance of the terminal is increased, the capacitive impedance is reduced, and the overall impedance of the terminal is increased during the transmission of a high-frequency signal, thereby being incapable of implementing impedance matching and not beneficial to the transmission of a high-frequency signal.

Therefore, a heretofore unaddressed need to design an improved electrical connector exists in the art to address the aforementioned deficiencies and inadequacies.

SUMMARY

In view of the aforementioned deficiencies in the related art, an elastic arm of a terminal is provided with a through slot, a tail end of the through slot does not go beyond a rear end of a supporting block located on one side of the elastic arm, and in such a way, the present invention is directed to an electrical connector of which the characteristic impedance of a terminal achieves impedance matching.

To achieve the foregoing objective, the present invention adopts the following technical solutions: an electrical connector is configured to be electrically connected to a chip module, and includes: an insulating body, provided with at least one accommodating groove, wherein the insulating body has a supporting block protrudingly provided upward at one side of the accommodating groove, and the supporting block is configured to upward support the chip module; and at least one terminal, correspondingly accommodated in the at least one accommodating groove, wherein the terminal includes: a first base, accommodated in the accommodating groove; an elastic arm, formed by bending and extending forward from the first base and located at one side of the supporting block, wherein the elastic arm is configured to be electrically connected to the chip module; and a through slot, running vertically through the elastic arm, wherein the supporting block has a rear end, the first base is located behind the rear end, and the through slot extends forward and does not pass beyond the rear end.

In certain embodiments, when the chip module presses the elastic arm and the supporting block upward abuts the chip module, the through slot passes forward beyond the rear end.

In certain embodiments, the elastic arm is higher than the through slot.

In certain embodiments, the elastic arm has a contact portion configured to be in contact with the chip module, and a front edge of the through slot ends behind the contact portion.

In certain embodiments, the first base is provided with a connecting portion located on an upper end thereof and connected with the elastic arm, the connecting portion is provided with a slot, and the slot communicates with the through slot.

In certain embodiments, a width of the through slot is greater than a width of the slot.

In certain embodiments, a height of the slot in a vertical direction is less than or equal to one half of a height of the first base.

In certain embodiments, the first base comprises a flat plate portion and the connecting portion obliquely provided upward and forward from the flat plate portion.

In certain embodiments, the terminal comprises a second base formed by bending and extending from one side of the first base, a bending portion is formed between the first base and the second base, and a lowest point of the slot in a vertical direction is lower than a top end of the bending portion.

In certain embodiments, the tail end of the elastic arm has a contact portion configured to be in contact with the chip module, a width of the contact portion is less than a width of the connecting portion, and an angle is formed between a side surface of the elastic arm adjacent to the supporting block and a front-rear direction.

In certain embodiments, the supporting block is located in front of the accommodating groove.

In certain embodiments, the elastic arm is provided with a contact portion configured to be connected with the chip module, the supporting block has a front end opposite to the rear end, and the contact portion is located in front of the front end.

In certain embodiments, the terminal comprises a second base formed by bending and extending from one side of the first base, the supporting block has a front end opposite to the rear end, and the second base is accommodated in the accommodating groove and located behind the front end.

In certain embodiments, the insulating body is provided with a plurality of accommodating grooves, one side of each of the accommodating grooves is provided with one of a plurality of supporting blocks, each of the supporting blocks is located between two adjacent ones of the accommodating grooves, each of the supporting blocks has a front end opposite to the rear end, and the front end is flush with one side of a corresponding one of the accommodating grooves.

In certain embodiments, the insulating body has a protruding block protrudingly provided upward at one side of the accommodating groove, a height of the protruding block is less than a height of the supporting block, and the elastic arm is located right above the protruding block.

In certain embodiments, the protruding block and the supporting block are connected with each other.

In certain embodiments, the protruding block comprises a first protruding block and a second protruding block connected with each other, the insulating body is provided with a plurality of accommodating grooves in a plurality of rows in a front-rear direction, and each of the rows is provided with a plurality of the accommodating grooves, the first protruding block is located between the accommodating grooves in two adjacent rows in the front-rear direction, and the second protruding block is located between two adjacent accommodating grooves in a same row.

In certain embodiments, the elastic arm has a contact portion configured to be in contact with the chip module, and the contact portion is located right above the second protruding block.

In certain embodiments, for the two adjacent accommodating grooves provided in the same row, the first protruding block provided corresponding to one of the two adjacent accommodating grooves and the supporting block are connected with each other, and the first protruding block is not connected with the supporting block provided corresponding to the other of the two adjacent accommodating grooves.

In certain embodiments, the terminal comprises a second base formed by bending and extending from the first base, and a strip connecting portion formed by extending upward from the second base, and the strip connecting portion is configured to be connected to a strip and located behind the rear end.

In certain embodiments, the second base extends obliquely downward to form an spring arm and a soldering portion formed by extending from a tail end of the spring arm.

Compared with the related art, certain embodiments of the present invention has the following beneficial effects.

The insulating body is provided with a supporting block in front of the first base of the terminal to support the chip module. The elastic arm of the terminal is provided with a through slot, and the through slot extends forward and does not pass beyond a rear end of the supporting block. Compared with the related art, such arrangement can lower the inductance of the terminal and increase the capacitance of the terminal, thereby lowering the impedance of the terminal as a whole, such that the characteristic impedance of the terminal can implement impedance matching. Meanwhile, the through slot does not pass beyond the rear end, such that a hollowing area of the elastic arm is reduced, and the hardness of the elastic arm can be increased, thereby increasing a positive force of the elastic arm of the terminal.

These and other aspects of the present invention will become apparent from the following description of the preferred embodiment taken in conjunction with the following drawings, although variations and modifications therein may be effected without departing from the spirit and scope of the novel concepts of the disclosure.

BRIEF DESCRIPTION OF THE DRAWINGS

The accompanying drawings illustrate one or more embodiments of the disclosure and together with the written description, serve to explain the principles of the disclosure. Wherever possible, the same reference numbers are used throughout the drawings to refer to the same or like elements of an embodiment, and wherein.

DETAILED DESCRIPTION

Figure 1:
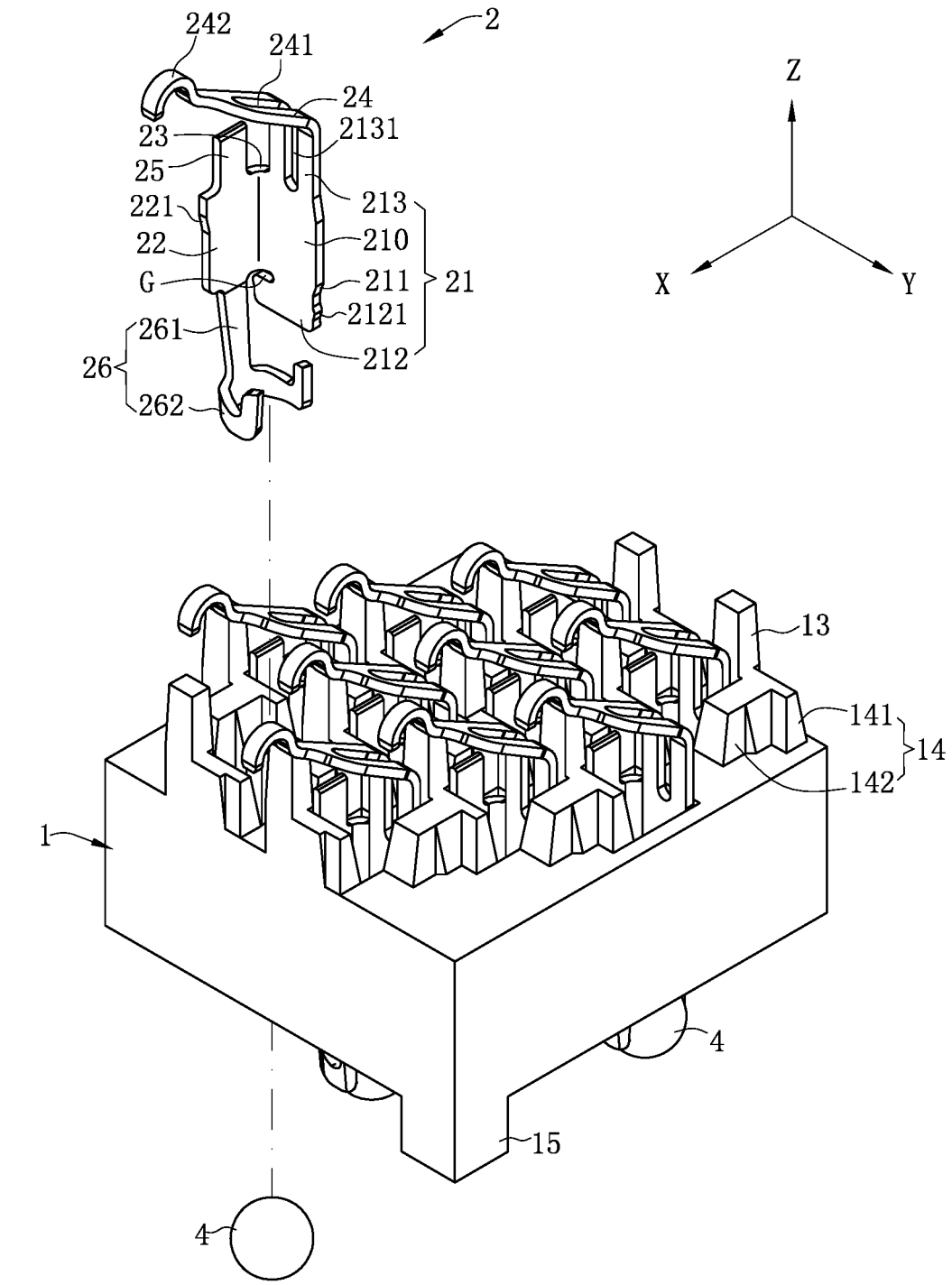
FIG. 1 is a perspective exploded view of an electrical connector according to a first embodiment of the present invention.

The present invention is more particularly described in the following examples that are intended as illustrative only since numerous modifications and variations therein will be apparent to those skilled in the art. Various embodiments of the invention are now described in detail. Referring to the drawings, like numbers indicate like components throughout the views. As used in the description herein and throughout the claims that follow, the meaning of "a", "an", and "the" includes plural reference unless the context clearly dictates otherwise. Also, as used in the description herein and throughout the claims that follow, the meaning of "in"

includes "in" and "on" unless the context clearly dictates otherwise. Moreover, titles or subtitles may be used in the specification for the convenience of a reader, which shall have no influence on the scope of the present invention.

It will be understood that when an element is referred to as being "on" another element, it can be directly on the other element or intervening elements may be present therebetween. In contrast, when an element is referred to as being "directly on" another element, there are no intervening elements present. As used herein, the term "and/or" includes any and all combinations of one or more of the associated listed items.

Furthermore, relative terms, such as "lower" or "bottom" and "upper" or "top," may be used herein to describe one element's relationship to another element as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The exemplary term "lower", can therefore, encompasses both an orientation of "lower" and "upper," depending of the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

As used herein, "around", "about" or "approximately" shall generally mean within 20 percent, preferably within 10 percent, and more preferably within 5 percent of a given value or range. Numerical quantities given herein are approximate, meaning that the term "around", "about" or "approximately" can be inferred if not expressly stated.

As used herein, the terms "comprising", "including", "carrying", "having", "containing", "involving", and the like are to be understood to be open-ended, i.e., to mean including but not limited to.

The description will be made as to the embodiments of the present invention in conjunction with the accompanying drawings in FIGS. 1-15. In accordance with the purposes of this invention, as embodied and broadly described herein, this invention, in one aspect, relates to an electrical connector.

FIG. 1 to FIG. 8 show an electrical connector according to a first embodiment of the present invention. The electrical connector 100 according to this embodiment of the present invention is used to electrically connect a chip module 200 to a circuit board 300, and the electrical connector 100 includes an insulating body 1 and multiple terminals 2 provided on the insulating body 1.

Figure 3:
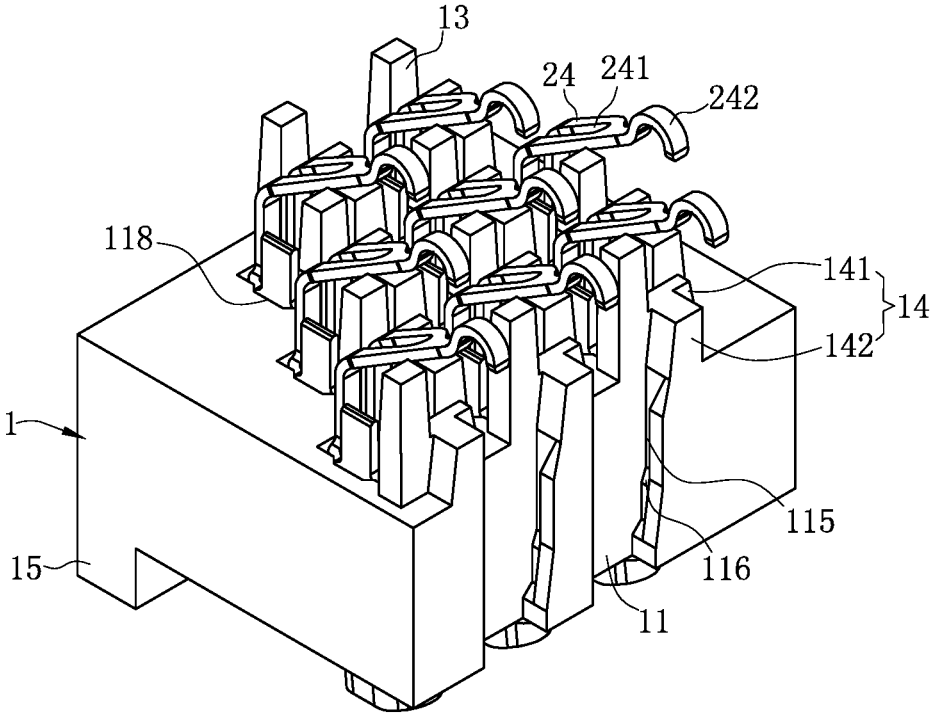
FIG. 3 is a perspective assembled sectional view of FIG. 1 from another viewing angle.
Figure 4:
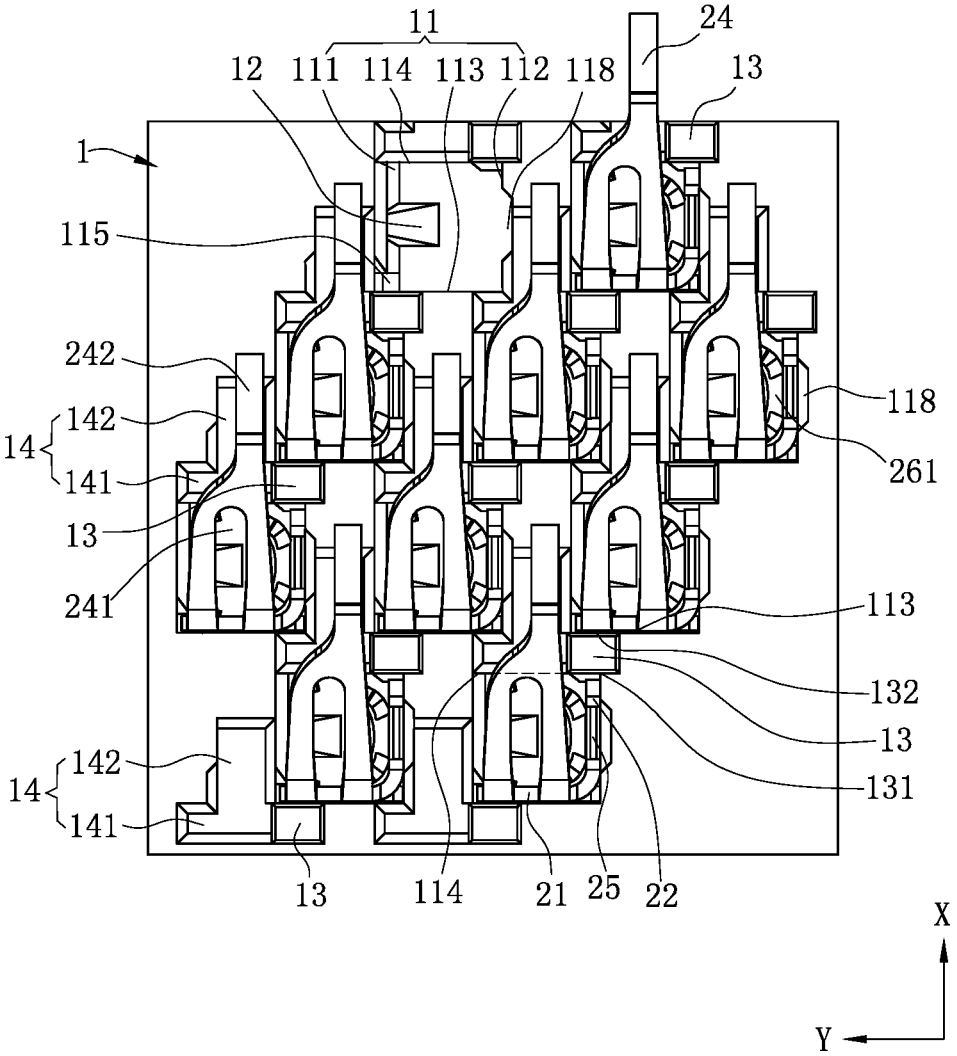
FIG. 4 is a top view of the electrical connector according to the first embodiment of the present invention, where a terminal is not pressed by a chip module.

As shown in FIG. 1, FIG. 3 and FIG. 4, an X-axis is defined as a front-rear direction, a Y-axis is defined as a left-right direction, and a Z-axis is defined as a vertical direction. The insulating body 1 is provided with multiple accommodating grooves 11 running through upper and lower surfaces thereof. The accommodating grooves 11 are provided in multiple rows in the front-rear direction, and the accommodating grooves 11 in two adjacent rows are staggeredly provided. Each of the accommodating grooves 11 has a first groove wall 111, a second groove wall 112, and a third groove wall 113 and a fourth groove wall 114 connecting the first groove wall 111 and the second groove wall 112. The first groove wall 111 and the second groove wall 112 are opposite to each other in the left-right direction, the third groove wall 113 and the fourth groove wall 114 are opposite to each other in the front-rear direction, and the fourth groove wall 114 is located in front of the third groove wall 113. Each of the accommodating grooves 11 has a first groove 115 formed by sinking from the first groove wall 111. The first groove 115 is adjacent to the third groove wall 113. The first groove 115 runs upward through an upper surface of the insulating body 1, but does not run through a lower surface of the insulating body 1. A groove wall of the first groove 115 is formed with a first blocking portion 116.

Figure 7:
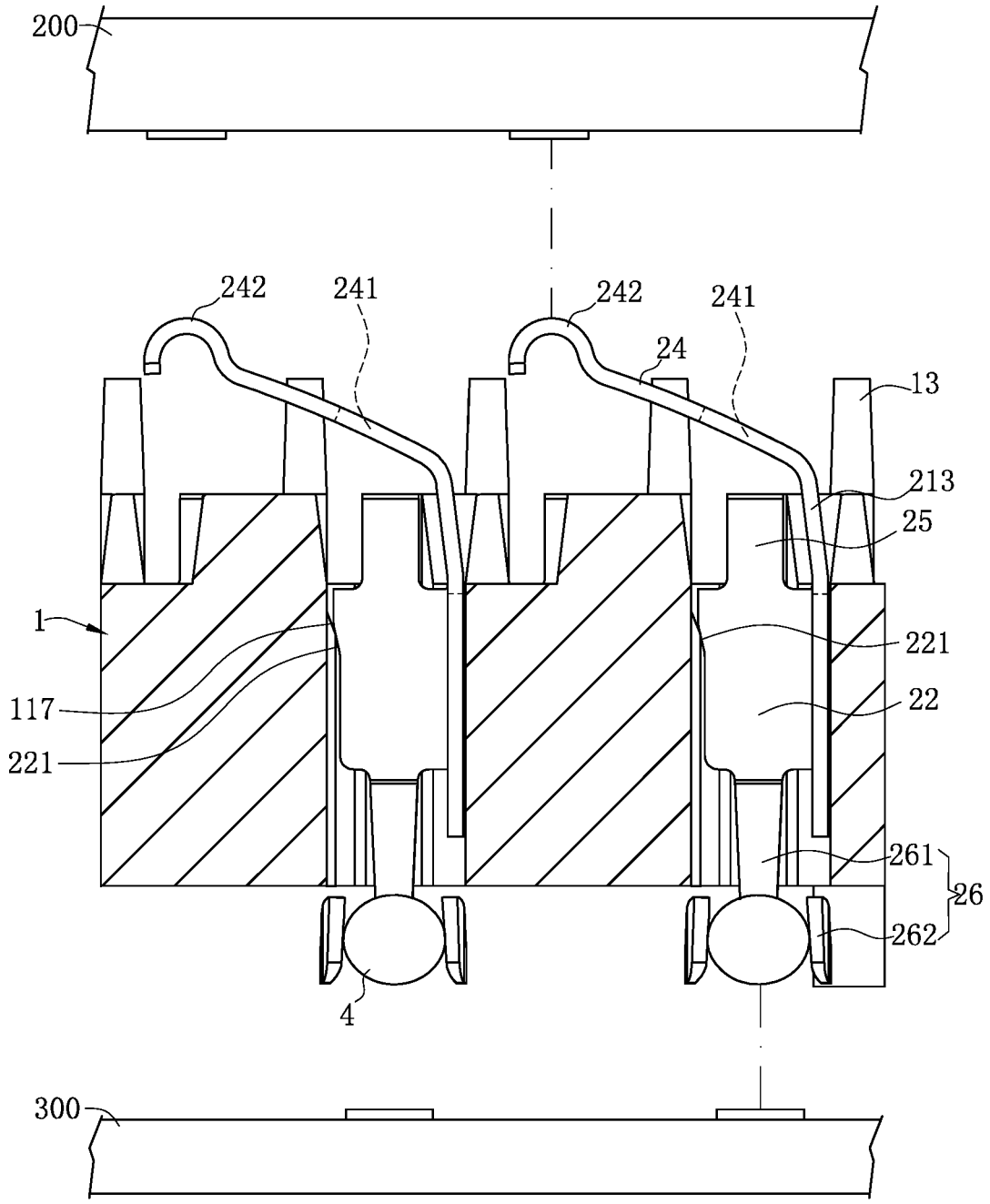
FIG. 7 is a sectional view of the electrical connector in FIG. 1 being connected with a chip module and a circuit board.
Figure 8:
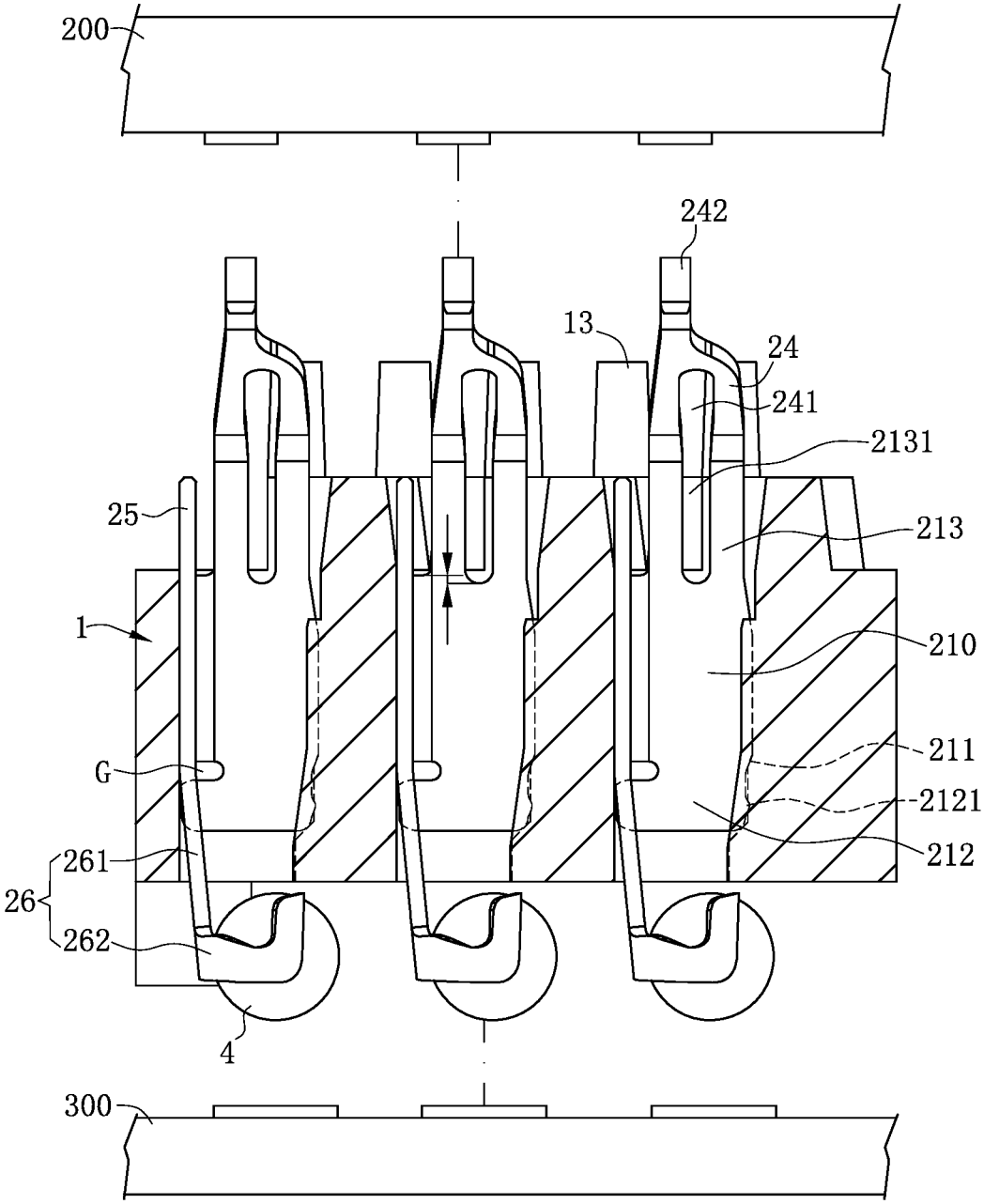
FIG. 8 is a sectional view of FIG. 7 from another viewing angle.

Referring to FIG. 7 and FIG. 8, a second blocking portion 117 is formed on the fourth groove wall 114. In this embodiment, each of the first blocking portion 116 and the second blocking portion 117 is a flat surface provided obliquely upward.

Figure 2:
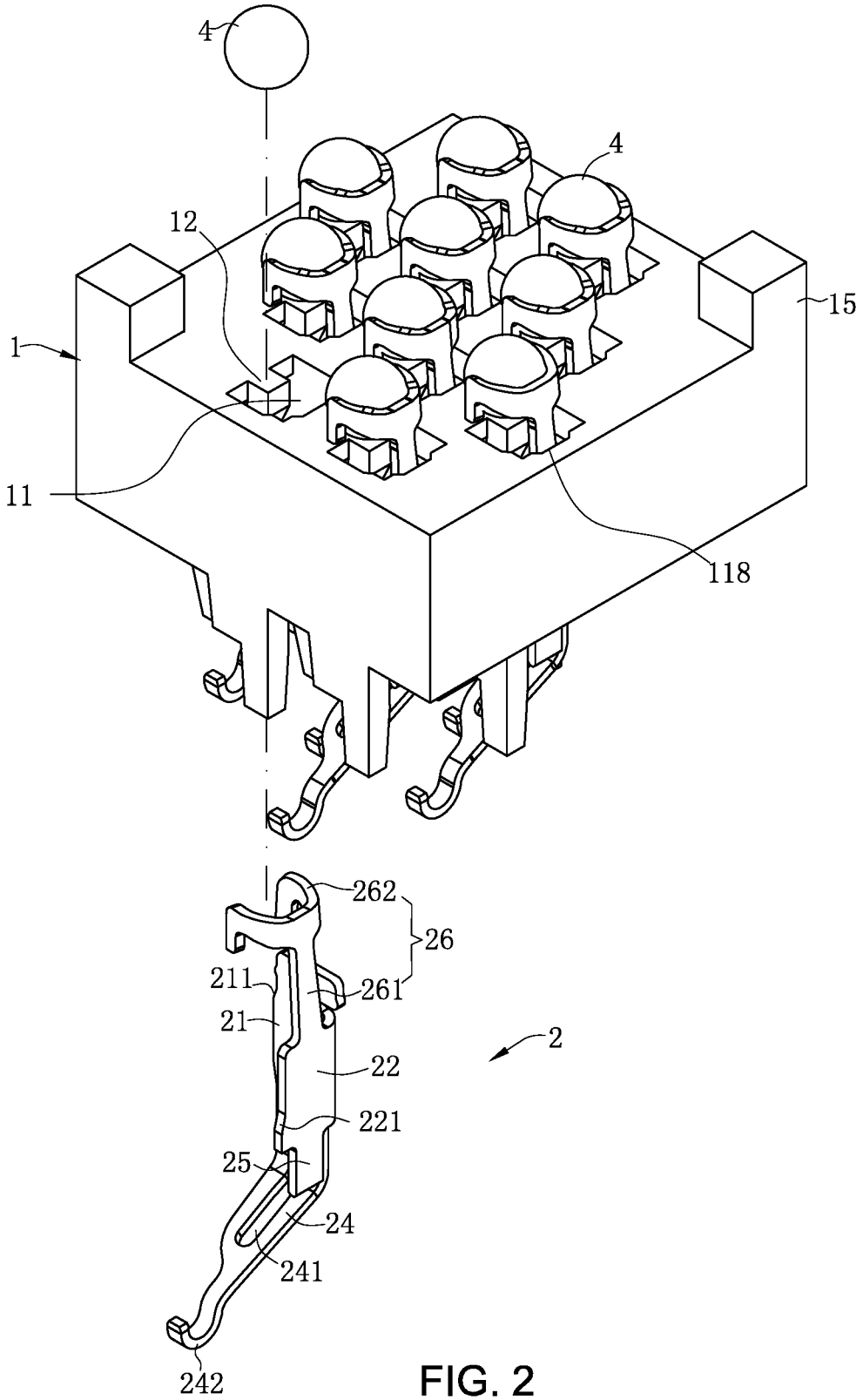
FIG. 2 is an inverted perspective exploded view of FIG. 1.

As shown in FIG. 2, FIG. 3 and FIG. 4, the accommodating groove 11 has a reserved slot 118 formed by sinking from the second groove wall 112, and the reserved slot 118 runs through the upper and lower surfaces of the insulating body 1. The insulating body 1 further has a stopping block 12 formed by protrudingly extending from the first groove wall 111 toward the inside of the accommodating groove 11. The stopping block 12 is located on a lower end of the accommodating groove 11, and the stopping block 12 and the reserved slot 118 are opposite to each other in the horizontal left-right direction.

As shown in FIG. 1 and FIG. 4, the upper surface of the insulating body 1 is provided with multiple supporting blocks 13 used to support the chip module 200. In this embodiment, each of the accommodating grooves 11 is correspondingly provided with one of the supporting blocks 13. Each supporting block 13 is located in front of the corresponding fourth groove wall 114. That is, the whole supporting block 13 is located in front of the corresponding accommodating groove 11, and the supporting block 13 is more adjacent to the second groove wall 112 than the first groove wall 111. Each supporting block 13 has a rear end 131 and a front end 132, and the front end 132 is opposite to the rear end 131. As shown in FIG. 4, when viewing in the vertical direction, the rear end 131 is flush with the fourth groove wall 114, and the front end 132 is flush with the third groove wall 113 of another accommodating groove 11. In other embodiments, the supporting block 13 is only partially located in front of the corresponding accommodating groove 11, and the rear end 131 extends backward to pass beyond the fourth groove wall 114, and is located between the two adjacent accommodating grooves 11 in the same row. The insulating body 1 further has multiple protruding blocks 14 protrudingly provided upward from the upper surface thereof. In this embodiment, only a left side of the supporting block 13 is correspondingly connected with the protruding block 14, and the supporting block 13 and the protruding block 14 integrally and approximately form a T-shaped structure. A height of the protruding block 14 is less than a height of the supporting block 13, and the supporting block 13 and the protruding block 14 connected therewith stretch across a width of the corresponding accommodating groove 11 in the left-right direction. Some of the protruding blocks 14 include a first protruding block 141 and a second protruding block 142 connected with each other and perpendicular to each other. The first protruding block 141 is connected with the corresponding supporting block 13 and located between the accommodating grooves 11 in two adjacent rows in the front-rear direction. The second protruding block 142 is located between the two adjacent accommodating grooves 11 in the same row. Some other protruding blocks 14 only includes the first protruding block 141. For the two adjacent accommodating grooves 11 provided in the same row, the first protruding block 141 provided corresponding to one of the two adjacent accommodating grooves 11 and the supporting block 13 are connected with each other, and the first protruding block 141 is not connected with the supporting block 13 provided corresponding to the other of the two adjacent accommodating grooves 11. Such arrangement can properly lower the hardness of the insulating body 1 and increase the flexibility of the insulating body 1. When the electrical connector 100 is loaded onto the circuit board 300 and enters a soldering furnace for soldering, the insulating body 1 can be heated and softened more easily, thereby avoiding stress concentration due to the terminals 2 being retained to the insulating body 1, and further effectively lowering the warping degree of the insulating body 1. In other embodiments, each of the accommodating grooves 11 is correspondingly provided with one of the supporting blocks 13.

As shown in FIG. 1 and FIG. 2, the lower surface of the insulating body 1 is provided with multiple feet 15 to support the circuit board 300, and the feet 15 are located on a boundary of the lower surface of the insulating body 1.

As shown in FIG. 1, FIG. 7 and FIG. 8, the terminals 2 are correspondingly provided in the accommodating grooves 11. Each of the terminals 2 has a first base 21 and a second base 22 accommodated in the accommodating groove 11, and the second base 22 is formed by bending and extending from one side edge of the first base 21 and forms an angle with the first base 21. In this embodiment, the angle is approximately 90 degrees. The first base 21 and the second base 22 are respectively located behind the rear end 131, and a bending portion 23 is formed between the first base 21 and the second base 22. The first base 21 is correspondingly retained to the first groove 115. The first base 21 has a flat plate portion 210 and a first position limiting portion 211 provided at one side of the flat plate portion 210 opposite to the bending portion 23. The bending portion 23 is connected to the flat plate portion 210, and the first position limiting portion 211 is limited by the first blocking portion 116, thereby preventing the terminal 2 from excessively moving downward. The first base 21 has a retaining portion 212 connected to a lower end of the flat plate portion 210 and extending downward. One side of the retaining portion 212 extends toward the second base 22 and forms a gap G with the bending portion 23 in the vertical direction. Two sides of the retaining portion 212 are provided with multiple clamping points 2121 to be in an interference fit with a groove wall of the first groove 115 and the second groove wall 112, so as to retain the terminal 2 to the insulating body 1. The first base 21 further has a connecting portion 213 connected to an upper end of the flat plate portion 210 and formed by extending upward. The connecting portion 213 is provided to be slightly obliquely forward. The connecting portion 213 protrudes upward out of the accommodating groove 11. The connecting portion 213 is provided with a slot 2131, and a height of the slot 2131 in the vertical direction does not exceed one half of a height of the first base 21. A lowest point of the slot 2131 in the vertical direction is lower than a top end of the bending portion 23. The connecting portion 213 bends and extends upward and forward to form an elastic arm 24. The elastic arm 24 protrudes out of the upper surface of the insulating body 1 and is located right above the corresponding protruding block 14 and at one side of the corresponding supporting block 13. The elastic arm 24 is provided with a through slot 241 provided in an extension direction thereof. The through slot 241 communicates with the slot 2131. A width W1 of the through slot 241 is greater than a width W2 of the slot 2131. The through slot 241 allows each of the terminals 2 and the chip module 200 to form multiple conductive paths.

Figure 5:
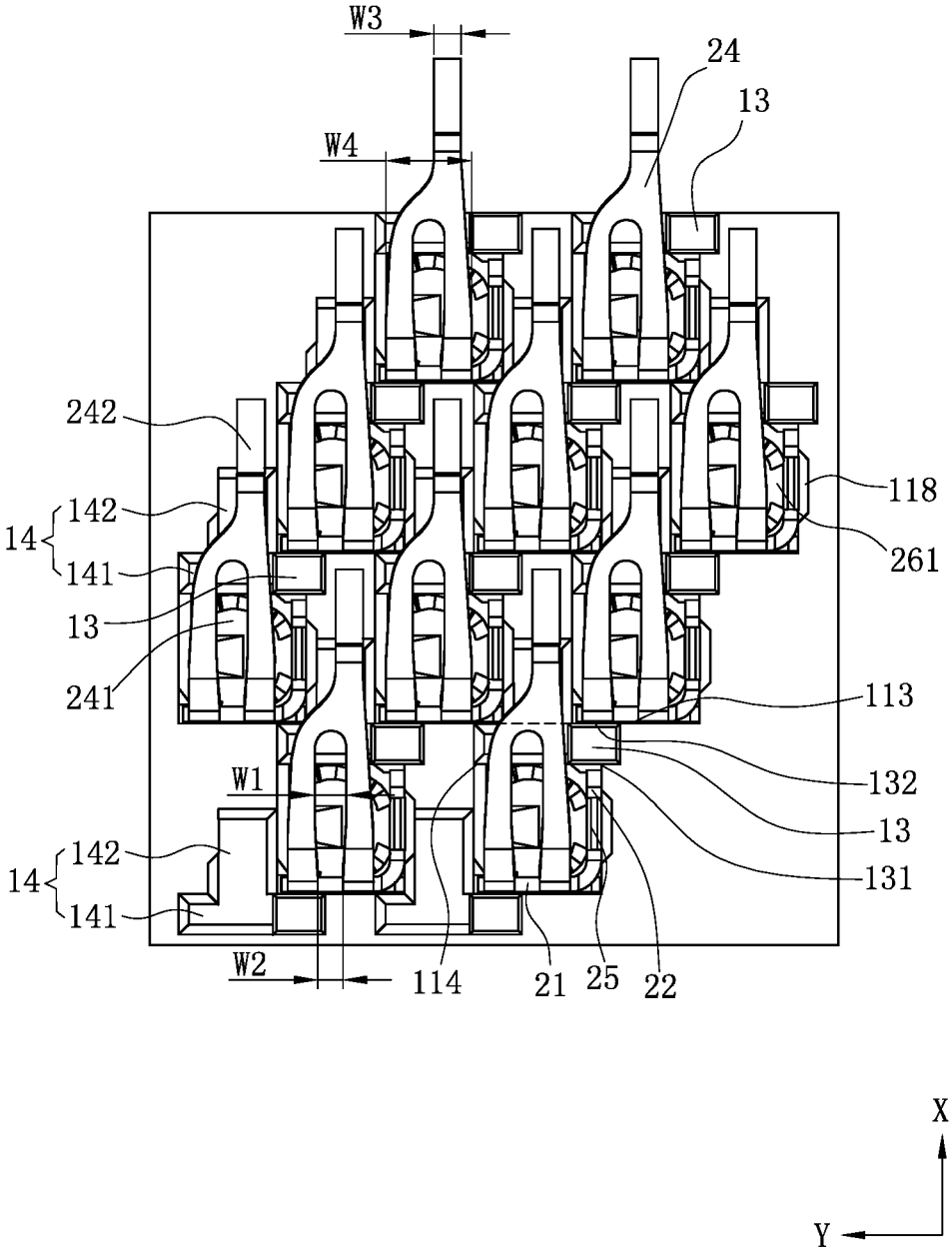
FIG. 5 is a top view of the electrical connector according to the first embodiment of the present invention, where the terminal is pressed by the chip module.

As shown in FIG. 4 and FIG. 7, when the chip module 200 does not press the terminal 2, viewing in the vertical direction, the through slot 241 does not pass beyond the rear end 131. In this embodiment, an interval is maintained between a tail end of the through slot 241 and the rear end 131 in the front-rear direction. Compared with the related art where a through slot extends forward to a tail end of a spring arm portion of a terminal, the inductive impedance of the terminal 2 is lowered, and the capacitive impedance is increased, thereby lowering the overall impedance of the terminal 2 to some extent, implementing the impedance matching of the characteristic impedance of the terminal 2, and further implementing the transmission of a high-frequency signal of the chip module 200. A tail end of the elastic arm 24 is higher than the through slot 241, and the elastic arm 24 has a contact portion 242 located at the tail end thereof to be conductively connected to the chip module 200. When viewing in the vertical direction, the contact portion 242 is located in front of the front end 132 and right above the second protruding block 142. A width W3 of the contact portion 242 is less than a width W4 of the connecting portion 213, and an angle is formed between a side surface of the elastic arm 24 adjacent to the supporting block 13 and the front-rear direction. A front edge of the through slot 241 ends behind the contact portion 242. That is, the through slot 241 does not run forward through the contact portion 242. As shown in FIG. 5, when the chip module 200 presses the terminal 2, viewing in the vertical direction, the through slot 241 passes forward beyond the rear end 131.

Figure 6:
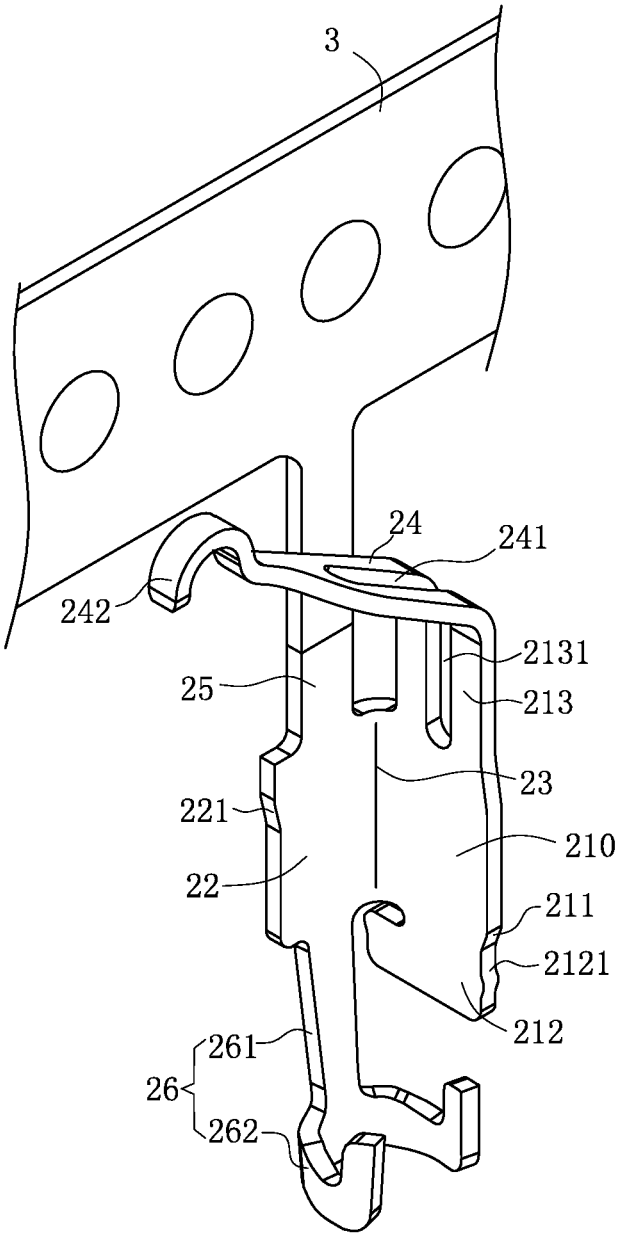
FIG. 6 is a perspective schematic view of the terminal in FIG. 1 being connected with a strip.

As shown in FIG. 4, FIG. 6 and FIG. 7, one side of the second base 22 away from the bending portion 23 is provided with a second position limiting portion 221, and the second position limiting portion 221 is limited by the second blocking portion 117, thereby preventing the terminal 2 from excessively moving downward. The second base 22 extends upward to form a strip connecting portion 25 to be connected to a strip 3. The strip connecting portion 25 is located behind the rear end 131, and the strip connecting portion 25 protrudes out of the upper surface of the insulating body 1 and is flush with a top end of the protruding block 14. The strip connecting portion 25 and the connecting portion 213 are spaced from each other. The second base 22 extends downward to form a conducting portion 26 to be conductively connected to the circuit board 300. The conducting portion 26 and the first base 21 are located at the same side of a plane of the second base 22, the conducting portion 26 has a spring arm 261 formed by extending obliquely downward and linearly from the second base 22, and a soldering portion 262 formed from a tail end of the spring arm 261. The spring arm 261 is a straight flat plate structure. The reserved slot 118 provides a space which facilitates the elastic deformation of the spring arm 261. The soldering portion 262 is provided with two clamping portions (not numbered) to clamp a solder ball 4. In other embodiments, the first base 21 may also be in a flat plate structure or other feasible structures.

As shown in FIG. 8, the first base 21 is provided with a connecting portion 213 located on an upper end thereof, the connecting portion 213 is provided with a slot 2131, and the height of the slot 2131 in the vertical direction does not exceed one half of the height of the first base 21, thereby ensuring the mechanical strength of the terminal 2 and increasing the elasticity of the elastic arm 24 and the connecting portion 213. Therefore, when the chip module 200 presses down the contact portion 242 on the elastic arm 24, the elastic arm 24 can be deformed more easily, thereby avoiding damage to the elastic arm 24, and further ensuring the stability of electrical connection between the electrical connector 100 and the chip module 200.

Figure 9:
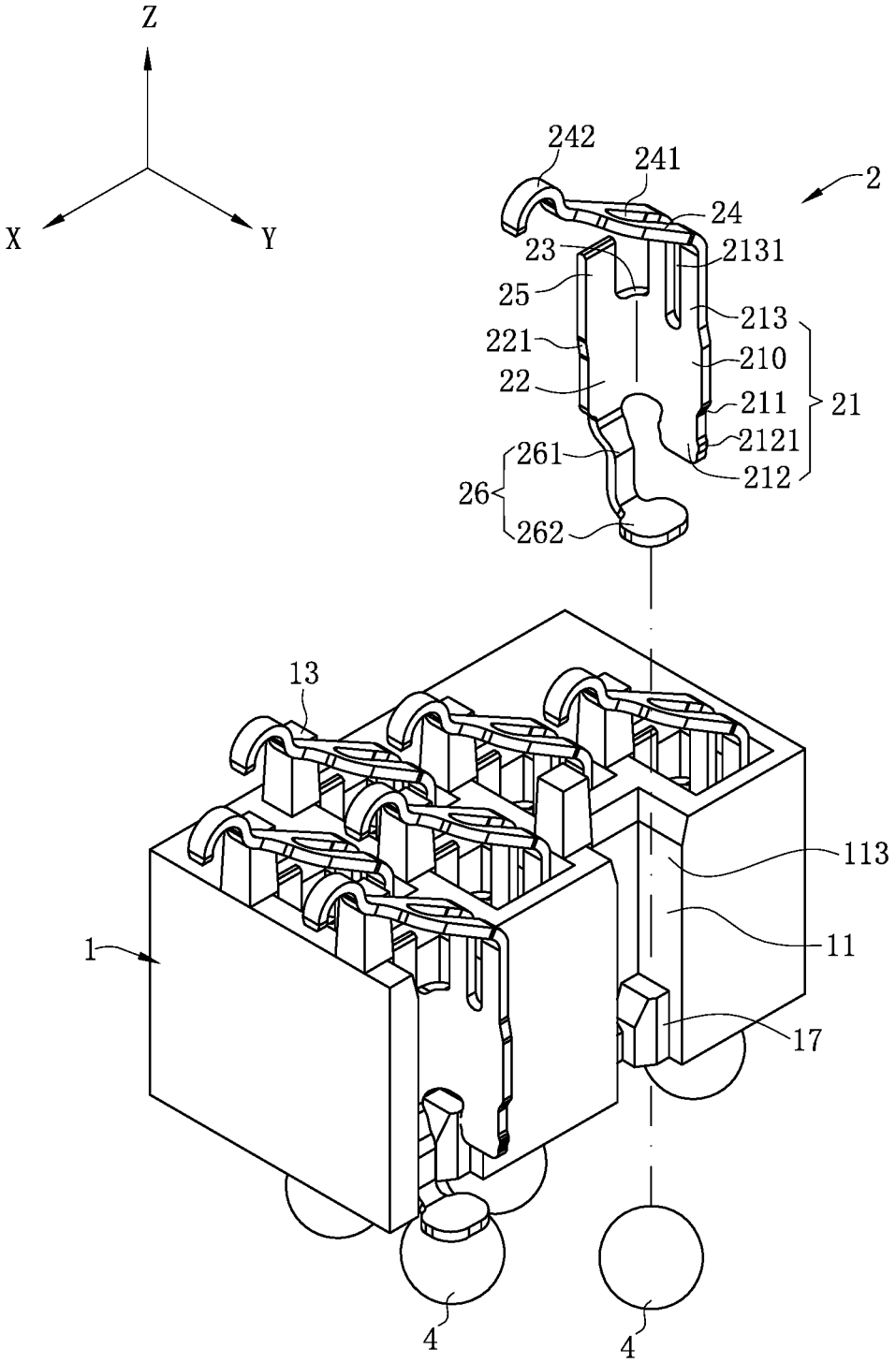
FIG. 9 is a perspective view of an electrical connector according to a second embodiment of the present invention.
Figure 10:
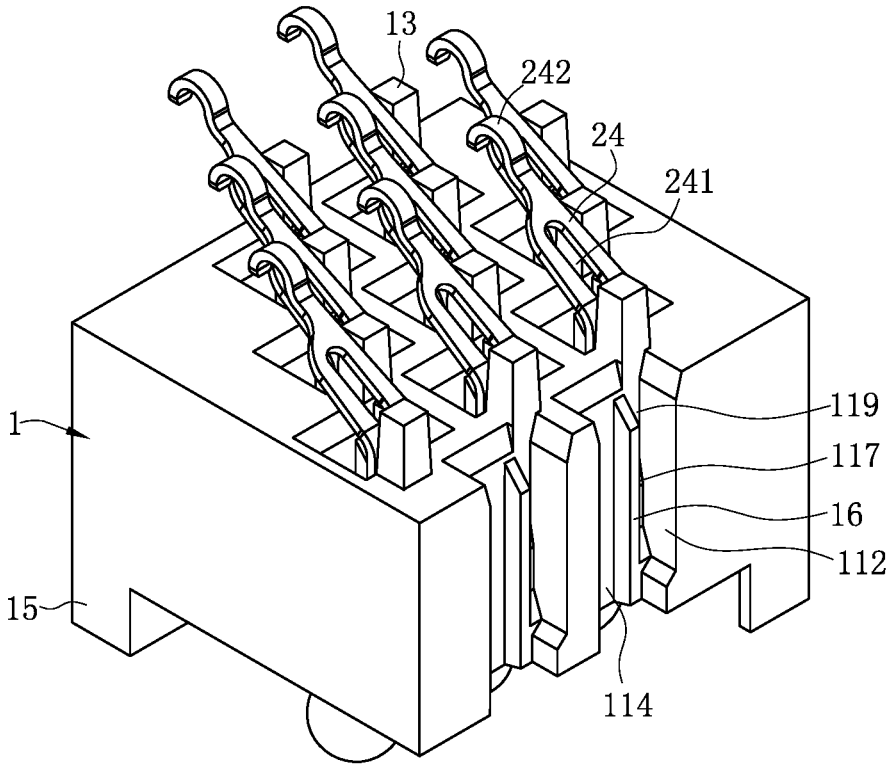
FIG. 10 is a perspective view of the electrical connector according to the second embodiment of the present invention from another viewing angle.
Figure 11:
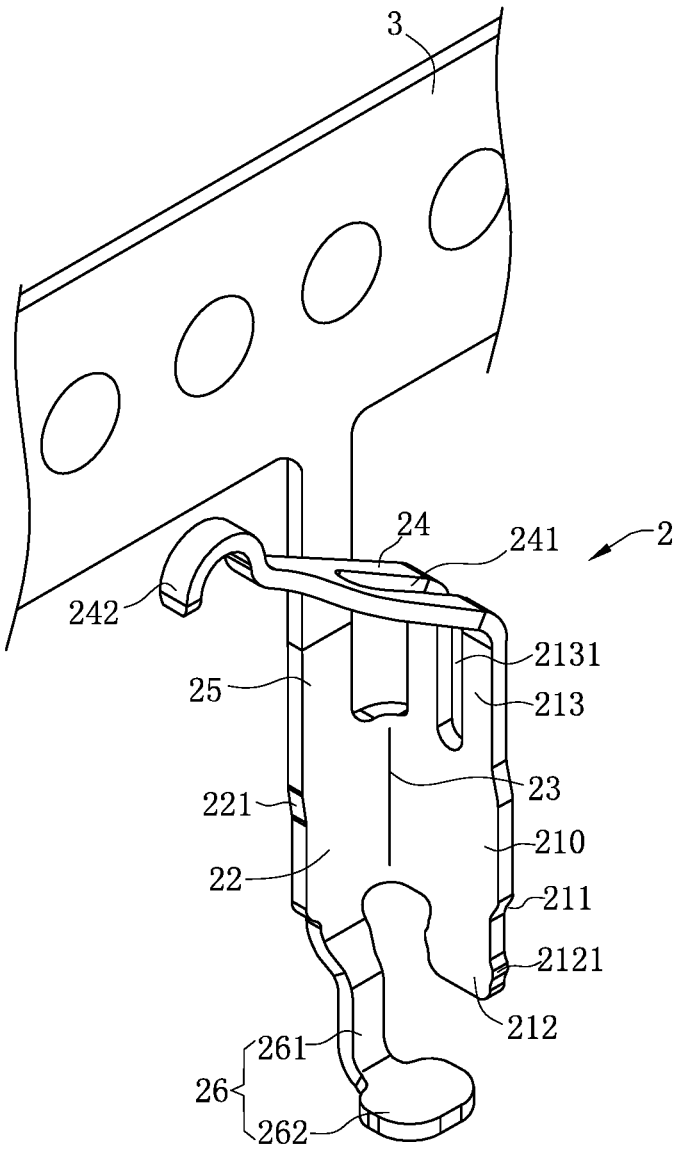
FIG. 11 is a perspective schematic view of a terminal in FIG. 9 being connected with a strip.
Figure 12:
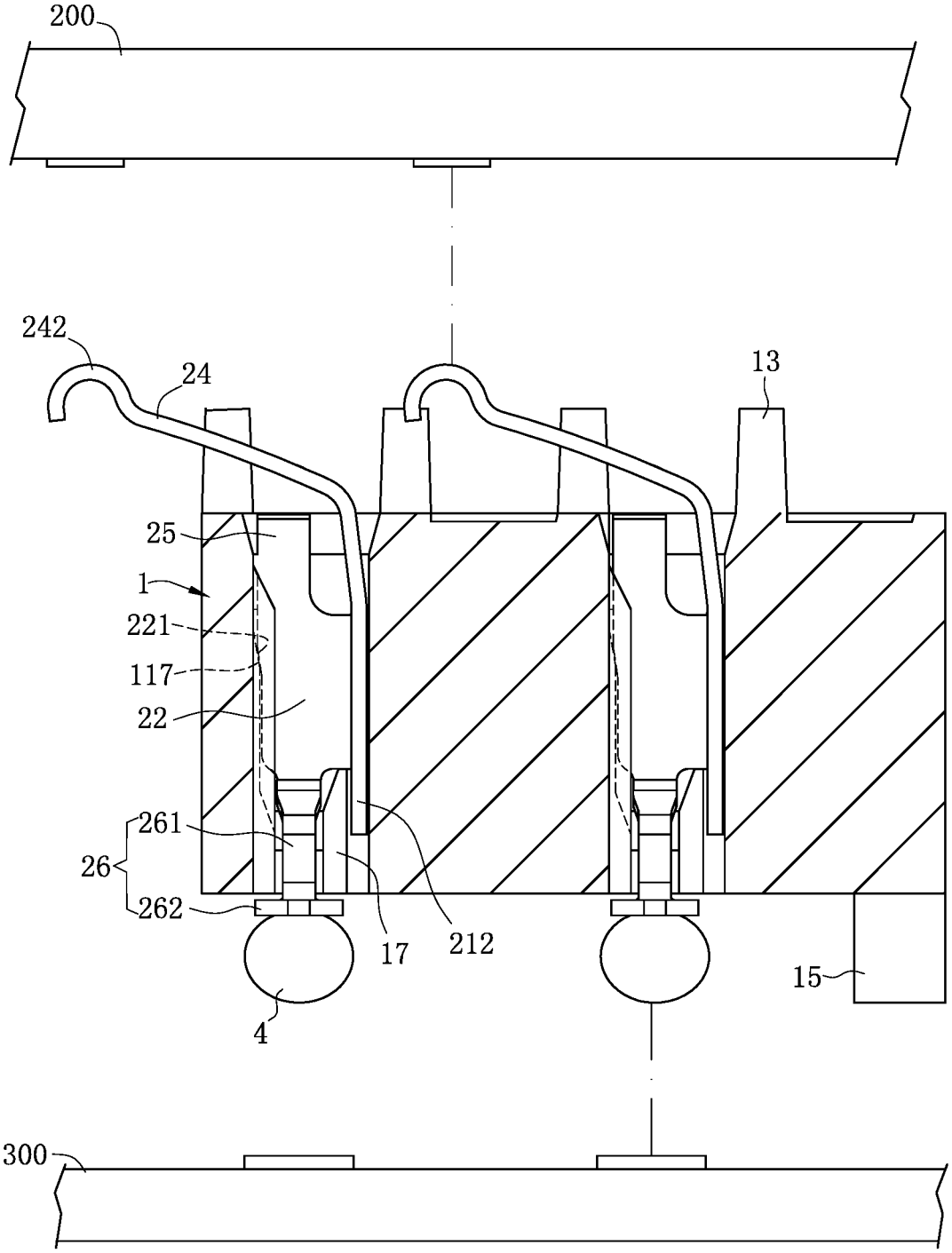
FIG. 12 is a sectional view of the electrical connector in FIG. 9 being connected with a chip module and a circuit board.
Figure 13:
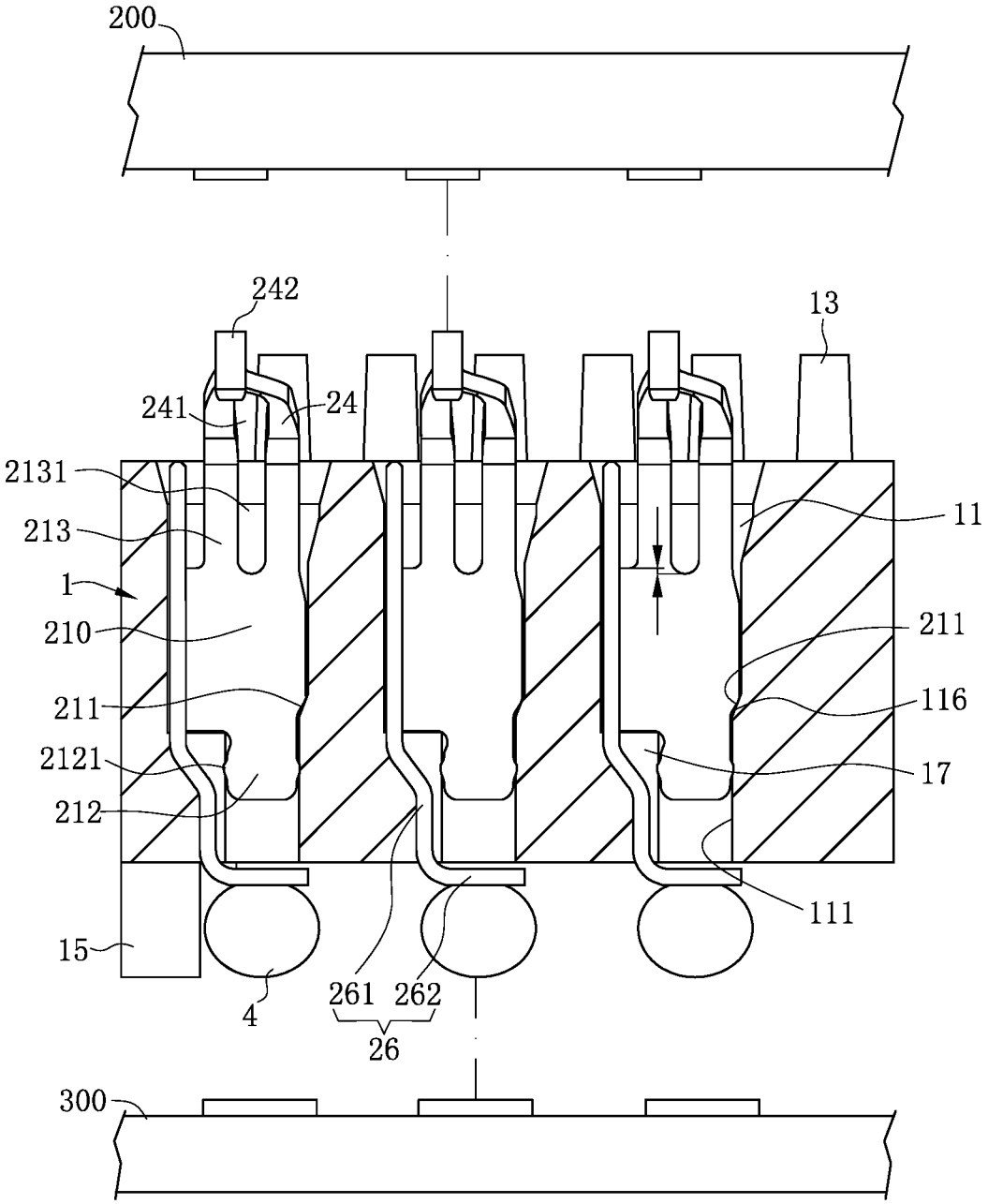
FIG. 13 is an exploded sectional view of FIG. 12 from another viewing angle.

FIG. 9 to FIG. 13 show an electrical connector according to a second embodiment of the present invention, which is different from the first embodiment in that:

As shown in FIG. 9, FIG. 10 and FIG. 13, each of the accommodating grooves 11 has a first blocking portion 116 formed on the first groove wall 111. The first blocking portion 116 is adjacent to the third groove wall 113. Each accommodating groove 11 has a protruding rib 16 protrudingly provided on the fourth groove wall 114. A second groove 119 is formed between the protruding rib 16 and the second groove wall 112, and the second groove 119 is adjacent to the second groove wall 112. A second blocking portion 117 is formed on a groove wall of the second groove 119, and the protruding rib 16 is partially located below the second groove 119. The insulating body 1 further has a stopping portion 17 formed by protruding from the second groove wall 112 toward the inside of the accommodating groove 11. The stopping portion 17 is connected with the third groove wall 113, and the stopping portion 17 is located on the lower end of the accommodating groove 11. A reserved slot 118 is formed between the stopping portion 17 and the protruding rib 16. The upper surface of the insulating body 1 is provided with multiple supporting blocks 13 in an area where the terminals 2 are located, to support the chip module 200.

Referring to FIG. 9 and FIG. 13, in this embodiment, the bending portion 23 is stopped by the stopping portion 17, thereby preventing the terminal 2 from excessively moving downward. The first base 21 has a retaining portion 212 located on a lower end thereof and only extends downward, and the retaining portion 212 is retained between the stopping portion 17 and the first groove wall 111. The strip connecting portion 25 is flush with the upper surface of the insulating body 1. The spring arm 261 is formed by firstly bending from the lower end of the second base 22 and then vertically extending downward. An interval is maintained between the vertically downward extending portion of the spring arm 261 and the retaining portion 212 in the horizontal direction. The soldering portion 262 bends from a tail end of the spring arm 261 and extends horizontally, and the soldering portion 262 is in a flat plate structure. The solder ball 4 is pre-soldered to the soldering portion 262. In other embodiments, the first base 21 may also be in a flat plate structure or other feasible structures. Other structures in this embodiment are identical or similar to the corresponding structures in the first embodiment, and are thus not elaborated herein.

Figure 14:
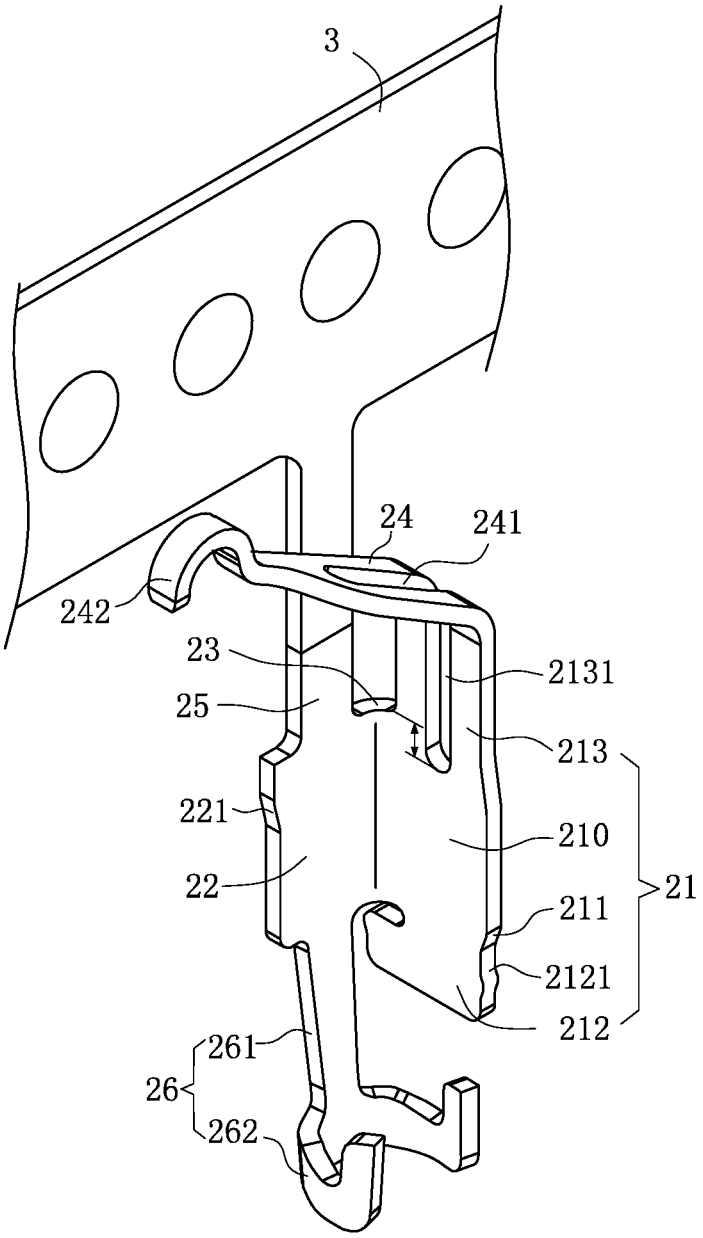
FIG. 14 is a perspective schematic view of an electrical connector according to a third embodiment of the present invention, where a terminal is connected with a strip.

FIG. 14 shows an electrical connector according to a third embodiment of the present invention, which is different from the first embodiment in a local structure of the terminal 2. The height of the slot 2131 in the vertical direction is greater than the height of the slot 2131 in the vertical direction in the first embodiment, but still does not exceed one half of the height of the first base 21. Other structures in this embodiment are identical or similar to the corresponding structures in the second embodiment, and are thus not elaborated herein.

Figure 15:
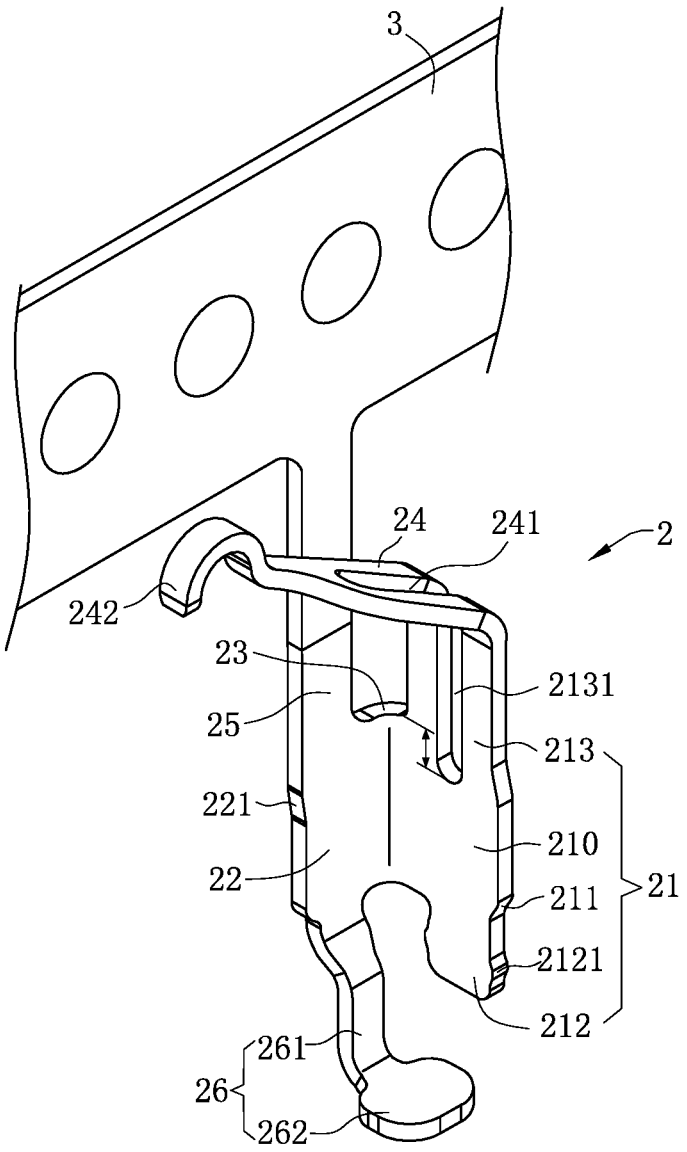
FIG. 15 is a perspective schematic view of an electrical connector according to a fourth embodiment of the present invention, where a terminal is connected with a strip.

FIG. 15 shows an electrical connector according to a fourth embodiment of the present invention, which is different from the second embodiment in a local structure of the terminal 2. The height of the slot 2131 in the vertical direction is greater than the height of the slot 2131 in the vertical direction in the second embodiment, but still does not exceed one half of the height of the first base 21. Other structures in this embodiment are identical or similar to the corresponding structures in the second embodiment, and are thus not elaborated herein.

To sum up, the electrical connector 100 according to certain embodiments of the present invention has the following beneficial effects:

1. The insulating body 1 has a supporting block 13 protrudingly provided upward on one side of the accommodating groove 11 to support the chip module 200. The supporting block 13 has a rear end 131. The first base 21 of the terminal 2 is located behind the rear end 131. The elastic arm 24 is provided with the through slot 241, and the through slot 241 extends forward and does not pass beyond the rear end 131 of the supporting block 13. Thus, such arrangement can lower the inductance of the terminal 2 and increase the capacitance of the terminal 2, thereby lowering the impedance of the terminal 2 as a whole, such that the characteristic impedance of the terminal 2 can implement impedance matching. Meanwhile, the through slot 241 does not pass beyond the rear end 131, such that a hollowing area of the elastic arm 24 is reduced, and the hardness of the elastic arm 24 can be increased, thereby increasing a positive force of the elastic arm 24 of the terminal 2.

2. The first base 21 is provided with a connecting portion 213 located on an upper end thereof, the connecting portion 213 is provided with a slot 2131, and the height of the slot 2131 in the vertical direction does not exceed one half of the height of the first base 21, thereby ensuring the mechanical strength of the terminal 2 and increasing the elasticity of the elastic arm 24 and the connecting portion 213. Therefore, when the chip module 200 presses down the contact portion 242 on the elastic arm 24, the elastic arm 24 can be deformed more easily, thereby avoiding damage to the elastic arm 24, and further ensuring the stability of electrical connection between the electrical connector 100 and the chip module 200.

3. The elastic arm 24 is formed by extending upward from the connecting portion 213. The first base 21 has the retaining portion 212 located on a lower end thereof and extends downward. That is, the first base 21 connected with the elastic arm 24 is provided with the retaining portion 212. Further, the retaining portion 212 is in interference fit with a groove wall of the accommodating groove 11, thereby avoiding the first base 21 from being suspended, and effectively reducing the shaking of the elastic arm 24 in the left-right direction. Therefore, when the chip module 200 presses or mates with the contact portion 242 and is impacted by an external force, stable electrical connection between the terminal 2 and the chip module 200 can be ensured.

4. The second base 22 extends downward to form a conducting portion 26. The conducting portion 26 has a spring arm 261 formed by extending obliquely downward and linearly from the second base 22, and a soldering portion 262 formed from a tail end of the spring arm 261. Therefore, when the solder ball 4 is soldered to the circuit board 300, the spring arm 261 has elasticity and thus can effectively prevent from the solder crack phenomenon between the electrical connector 100 and the circuit board 300 due to temperature change before and after passing through a reflow oven.

5. The conducting portion 26 and the first base 21 are located at the same side of a plane of the second base 22. Such arrangement can effectively reduce the occupied space of the terminal 2 in the horizontal direction. and correspondingly reduce the hole diameter of the accommodating groove 11. Thus, when the insulating body 1 is provided with the accommodating groove 11, the material hollowing amount can be reduced, thereby ensuring the structural strength of the insulating body 1.

The foregoing description of the exemplary embodiments of the invention has been presented only for the purposes of illustration and description and is not intended to be exhaustive or to limit the invention to the precise forms disclosed. Many modifications and variations are possible in light of the above teaching.

The embodiments were chosen and described in order to explain the principles of the invention and their practical application so as to activate others skilled in the art to utilize the invention and various embodiments and with various modifications as are suited to the particular use contemplated. Alternative embodiments will become apparent to those skilled in the art to which the present invention pertains without departing from its spirit and scope. Accordingly, the scope of the present invention is defined by the appended claims rather than the foregoing description and the exemplary embodiments described therein.

What is claimed is:

1. An electrical connector, configured to be electrically connected to a chip module, the electrical connector comprising:

an insulating body, provided with at least one accommodating groove, wherein the insulating body has a supporting block protrudingly provided upward at one side of the accommodating groove, and the supporting block is configured to upward support the chip module; and at least one terminal, correspondingly accommodated in the at least one accommodating groove, wherein the terminal comprises:

a first base, accommodated in the accommodating groove;

an elastic arm, formed by bending and extending forward from the first base and located at one side of the supporting block, wherein the elastic arm is configured to be electrically connected to the chip module; and a through slot, running vertically through the elastic arm, wherein the supporting block has a rear end, the first base is located behind the rear end, and the through slot extends forward and does not pass beyond the rear end.

2. The electrical connector according to claim 1, wherein when the chip module presses the elastic arm and the supporting block upward abuts the chip module, the through slot passes forward beyond the rear end.

3. The electrical connector according to claim 1, wherein the elastic arm has a contact portion configured to be in contact with the chip module, and a front edge of the through slot ends behind the contact portion.

4. The electrical connector according to claim 1, wherein the first base is provided with a connecting portion located on an upper end thereof and connected with the elastic arm, the connecting portion is provided with a slot, and the slot communicates with the through slot.

5. The electrical connector according to claim 4, wherein a width of the through slot is greater than a width of the slot.

6. The electrical connector according to claim 4, wherein a height of the slot in a vertical direction is less than or equal to one half of a height of the first base.

7. The electrical connector according to claim 4, wherein the first base comprises a flat plate portion and the connecting portion obliquely provided upward and forward from the flat plate portion.

8. The electrical connector according to claim 4, wherein the terminal comprises a second base formed by bending and extending from one side of the first base, a bending portion is formed between the first base and the second base, and a lowest point of the slot in a vertical direction is lower than a top end of the bending portion.

9. The electrical connector according to claim 4, wherein the elastic arm has a contact portion configured to be in contact with the chip module, a width of the contact portion is less than a width of the connecting portion, and an angle is formed between a side surface of the elastic arm adjacent to the supporting block and a front-rear direction.

10. The electrical connector according to claim 1, wherein the supporting block is located in front of the accommodating groove.

11. The electrical connector according to claim 1, wherein the elastic arm is provided with a contact portion configured to be connected with the chip module, the supporting block has a front end opposite to the rear end, and the contact portion is located in front of the front end.

12. The electrical connector according to claim 1, wherein the terminal comprises a second base formed by bending and extending from one side of the first base, the supporting block has a front end opposite to the rear end, and the second base is accommodated in the accommodating groove and located behind the front end.

13. The electrical connector according to claim 1, wherein the insulating body is provided with a plurality of accommodating grooves, one side of each of the accommodating grooves is provided with one of a plurality of supporting blocks, each of the supporting blocks is located between two adjacent ones of the accommodating grooves, each of the supporting blocks has a front end opposite to the rear end, and the front end is flush with one side of a corresponding one of the accommodating grooves.

14. The electrical connector according to claim 1, wherein the insulating body has a protruding block protrudingly provided upward at one side of the accommodating groove, a height of the protruding block is less than a height of the supporting block, and the elastic arm is located right above the protruding block.

15. The electrical connector according to claim 14, wherein the protruding block and the supporting block are connected with each other.

16. The electrical connector according to claim 14, wherein the protruding block comprises a first protruding block and a second protruding block connected with each other, the insulating body is provided with a plurality of accommodating grooves in a plurality of rows in a front-rear direction, and each of the rows is provided with a plurality of the accommodating grooves, the first protruding block is located between the accommodating grooves in two adjacent rows in the front-rear direction, and the second protruding block is located between two adjacent accommodating grooves in a same row.

17. The electrical connector according to claim 16, wherein the elastic arm has a contact portion configured to be in contact with the chip module, and the contact portion is located right above the second protruding block.

18. The electrical connector according to claim 16, wherein for the two adjacent accommodating grooves provided in the same row, the first protruding block provided corresponding to one of the two adjacent accommodating grooves and the supporting block are connected with each other, and the first protruding block is not connected with the supporting block provided corresponding to the other of the two adjacent accommodating grooves.

19. The electrical connector according to claim 1, wherein the terminal comprises a second base formed by bending and extending from the first base, and a strip connecting portion formed by extending upward from the second base, and the strip connecting portion is configured to be connected to a strip and located behind the rear end.

20. The electrical connector according to claim 19, wherein the second base extends obliquely downward to form an spring arm and a soldering portion formed by extending from a tail end of the spring arm.

* * * * *